US011098481B2

(12) United States Patent
Waters et al.

(10) Patent No.: US 11,098,481 B2
(45) Date of Patent: Aug. 24, 2021

(54) CANOPY SYSTEM AND GROUP SUSPENSION SYSTEM THEREFORE

(71) Applicant: ARMSTRONG WORLD INDUSTRIES, INC., Lancaster, PA (US)

(72) Inventors: James R. Waters, Lancaster, PA (US); James P. Rineer, Pequea, PA (US); Brian L. Springer, Lancaster, PA (US); William H. Frantz, Elizabethtown, PA (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

(21) Appl. No.: 16/940,903

(22) Filed: Jul. 28, 2020

(65) Prior Publication Data

US 2020/0354954 A1 Nov. 12, 2020

Related U.S. Application Data

(63) Continuation of application No. 16/246,825, filed on Jan. 14, 2019, now Pat. No. 10,724,237, which is a (Continued)

(51) Int. Cl.
*E04B 9/22* (2006.01)
*E04B 9/04* (2006.01)
(Continued)

(52) U.S. Cl.
CPC ..... *E04B 9/225* (2013.01); *E04B 9/04* (2013.01); *E04B 9/0464* (2013.01); *E04B 9/067* (2013.01);
(Continued)

(58) Field of Classification Search
None
See application file for complete search history.

(56) References Cited

U.S. PATENT DOCUMENTS 2,785,099 A 3/1957 Holtsford
2,882,558 A 4/1959 Jacobson et al.
(Continued)

FOREIGN PATENT DOCUMENTS

DE 1170600 5/1964
GB 2128218 A * 4/1984 ..... E04B 9/225
WO 2007/012077 1/2007

*Primary Examiner* — Joshua K Ihezie
(74) *Attorney, Agent, or Firm* — Craig M. Sterner

(57) ABSTRACT

A ceiling system for use in an interior building environment. In one aspect, the invention may be a ceiling system comprising: a frame comprising a plurality of struts; a plurality of modules, each of the modules comprising a panel and a plurality of hook members coupled to and extending from a top surface of the panel; each of the hook members comprising: an upstanding section; a hook portion at a top end of the upstanding section, the hook portion defining a downwardly-facing open slot; and an attachment flange at a bottom end of the upstanding section that couples the hook member to the top surface of the panel; and the modules mounted to the frame, and wherein for each of the modules, the hook portions of the hook members fit over and rest upon the struts, the struts located in the downwardly-facing open slots of the hook portions.

11 Claims, 4 Drawing Sheets

Related U.S. Application Data continuation of application No. 15/064,281, filed on Mar. 8, 2016, now abandoned, which is a continuation of application No. 14/615,810, filed on Feb. 6, 2015, now Pat. No. 9,279,252, which is a continuation of application No. 14/095,674, filed on Dec. 3, 2013, now Pat. No. 8,950,146, which is a continuation of application No. 12/157,248, filed on Jun. 9, 2008, now Pat. No. 8,596,008.

(60) Provisional application No. 60/933,803, filed on Jun. 8, 2007.

(51) Int. Cl.

| | |
|---|---|
| ***E04B 9/28*** | (2006.01) |
| ***E04B 9/34*** | (2006.01) |
| ***E04B 9/18*** | (2006.01) |
| ***E04B 9/06*** | (2006.01) |
| ***E04B 9/10*** | (2006.01) |

(52) U.S. Cl.

CPC ..... *E04B 9/10* (2013.01); *E04B 9/18* (2013.01); *E04B 9/28* (2013.01); *E04B 9/34* (2013.01)

(56) References Cited

U.S. PATENT DOCUMENTS

| | | | | |
|---|---|---|---|---|
| 2,904,140 | A | | 9/1959 | Cleary |
| 3,032,833 | A | | 5/1962 | Stanley |
| 3,708,941 | A | | 1/1973 | Cuckson |
| 3,729,891 | A | | 5/1973 | Olsen |
| 3,782,065 | A | | 1/1974 | Griffing |
| 3,798,446 | A | | 3/1974 | Deaton |
| 3,817,014 | A | | 6/1974 | Jones |
| 3,973,368 | A | | 8/1976 | Moeller |
| 3,998,419 | A | | 12/1976 | Semmerling |
| 4,034,531 | A | | 7/1977 | Balinski |
| 4,089,146 | A | | 5/1978 | Martinez |
| 4,438,613 | A | | 3/1984 | Hinsta et al. |
| 4,463,537 | A | | 8/1984 | Rodriquez et al. |
| 4,471,596 | A | | 9/1984 | Deaton et al. |
| 4,548,010 | A | | 10/1985 | Hintsa |
| 4,640,075 | A | | 2/1987 | Nuncio |
| 4,693,174 | A | | 9/1987 | Anderson |
| 4,717,099 | A | | 1/1988 | Hubbard |
| 4,744,188 | A | | 5/1988 | Ahren |
| 4,862,663 | A | | 9/1989 | Krieger |
| 5,024,034 | A | | 6/1991 | Gailey |
| 5,241,799 | A | | 9/1993 | Jahn |
| 5,279,090 | A | | 1/1994 | Yamaguchi et al. |
| 5,311,719 | A | * | 5/1994 | Jahn ..... E04B 9/003 52/506.09 |
| 5,357,722 | A | * | 10/1994 | Kessler ..... E04B 7/022 52/198 |
| 5,428,930 | A | | 7/1995 | Bagley |
| 5,435,514 | A | | 7/1995 | Kerr, Jr. |
| 5,482,240 | A | | 1/1996 | Caraher |
| 5,535,566 | A | | 7/1996 | Wilson et al. |
| 5,871,556 | A | | 2/1999 | Jeanseau et al. |
| 6,092,777 | A | | 7/2000 | Kuntz |
| 6,123,154 | A | | 9/2000 | MacDonald et al. |
| 6,311,626 | B1 | | 11/2001 | Roberts |
| 6,318,042 | B1 | | 11/2001 | Bloom et al. |
| 6,834,467 | B2 | | 12/2004 | Gulbrandsen et al. |
| 6,907,938 | B2 | | 6/2005 | MacDonald et al. |
| 7,681,370 | B2 | | 3/2010 | Waters et al. |
| 7,798,341 | B2 | | 9/2010 | Richardson et al. |
| 8,087,631 | B1 | | 1/2012 | Gretz |
| 8,096,089 | B2 | | 1/2012 | Platt |
| 8,596,008 | B2 | | 12/2013 | Waters |
| 8,596,009 | B2 | * | 12/2013 | Baxter ..... E04B 9/10 52/506.06 |
| 8,950,146 | B2 | | 2/2015 | Waters |
| 2002/0100248 | A1 | | 8/2002 | D'Agata |
| 2003/0205016 | A1 | | 11/2003 | Gulbrandsen et al. |
| 2004/0172907 | A1 | | 9/2004 | Krantz-Lilienthal et al. |
| 2005/0034402 | A1 | | 2/2005 | Johnson |
| 2006/0005495 | A1 | | 1/2006 | Stessel et al. |
| 2006/0070967 | A1 | | 4/2006 | Schaubeck et al. |
| 2010/0064617 | A1 | | 3/2010 | Kelley et al. |

* cited by examiner

CANOPY SYSTEM AND GROUP SUSPENSION SYSTEM THEREFORE

CROSS-REFERENCE TO RELATED APPLICATIONS

The present application is a continuation of U.S. Nonprovisional patent application Ser. No. 16/246,825, filed Jan. 14, 2019, which in turn is a continuation of U.S. Nonprovisional patent application Ser. No. 15/064,281, filed Mar. 8, 2016, which is a continuation of U.S. Nonprovisional patent application Ser. No. 14/615,810, filed Feb. 6, 2015, now U.S. Pat. No. 9,279,252, which in turn is a continuation of U.S. Nonprovisional patent application Ser. No. 14/095,674, filed Dec. 3, 2013, now U.S. Pat. No. 8,950,146, which in turn is a continuation of U.S. Nonprovisional patent application Ser. No. 12/157,248, filed Jun. 9, 2008, now U.S. Pat. No. 8,596,008, which in turn claims the benefit of U.S. Provisional Patent Application No. 60/933,803, filed Jun. 8, 2007, the entireties of which are incorporated by reference herein.

BACKGROUND OF THE INVENTION

The present invention is directed to a canopy system, and, more particularly, a canopy system which provides mechanical alignment and registration of the canopy modules when grouped together.

Exposed structure types of spaces which utilize suspended ceiling islands or ceiling canopies are in increasing demand. Such systems provide architects and designers with the ability to create unique and dramatic visual effects not available with continuous, wall-to-wall ceiling systems.

For aesthetic purposes, it is desirable for the ceiling canopies to have clean, finished edges free of any exposed, unsightly edge detail or fastening means. One solution for providing this desired edge detail is shown and described in U.S. Patent Application Publication No. 2007/0033902, entitled "Suspension Systems" (hereinafter "the 2007/0033902 application publication").

Canopy systems have unique code requirements which dictate the placement of the individual canopies relative one another. For example, in areas which experience seismic activity, each independently hung canopy, when hung in the ceiling space, must be spaced 18 inches apart from one another, as well as 18 inches apart from any other building component.

Additionally, irrespective of the level of seismic activity, there are additional installation concerns, including concerns regarding alignment and registration of canopies when grouped together in the ceiling space. Alignment and registration are currently achieved through careful installation which is time consuming, which, in turn, adds cost to the system. Another concern with current canopy systems is that they currently require several attachment points to the overhead building structure. Reduction in the number of hanging points will reduce installation time and cost as well as eliminate points of electrical and mechanical interference.

Thus, the present invention is directed to a system that meets the seismic code requirements and provides a means to mechanically align and register the individual canopies with one another. Also provided is a system having a minimum number of attachment points to the overhead building structure.

BRIEF SUMMARY OF THE INVENTION

The present invention is directed to an improved canopy system. The system includes a grouping frame and at least one canopy module. The grouping frame includes at least two intersecting struts. The canopy module includes a panel and suspension hardware. The suspension hardware includes at least one suspension bar which is attached to the back surface of the panel at an in-board location. Each of the intersecting struts has a hook member attached thereto. Each hook member rests on, and is supported by, a strut.

When installed, the canopy module is locked to the grouping frame in both its longitudinal and cross axes. Additionally, the grouping frame and the attachment hardware of the canopy module works in combination to mechanically register and align two or more canopy modules relative one another.

The improved canopy system provides: downward accessibility; a rigid suspension system that complies with seismic codes; a mechanism for multiple individual canopies to act as one and be installed in close proximity; ease in installation in terms of panel spacing and alignment; and a reduction in the number of attachment points to the overhead building structure by 25-50%.

In one embodiment, the invention can be a canopy system comprising: a grouping frame comprising a plurality of first struts and a plurality of second struts, the second struts intersecting the first struts; a plurality of canopy modules; each of the plurality of canopy modules comprising a panel and a plurality of hook members attached to the panel; and wherein for each of the plurality of canopy modules, the plurality of hook members comprise a first hook member coupled to one of the first struts and a second hook member coupled to one of the second struts.

In another embodiment, the invention can be a canopy system comprising: a grouping frame comprising at least two intersecting struts, the grouping frame suspended from an overhead building structure by at least one hanging device; at least two canopy modules, each of the at least two canopy modules comprising a panel, at least one suspension bar attached to the panel at an in-board location of the panel, and a plurality of hook members attached to the suspension bar and extending therefrom in a direction substantially perpendicular to the suspension bar; and wherein each of the intersecting struts has at least one of the plurality of hook members coupled thereto.

In a further embodiment, the invention can be a canopy system comprising: a grouping frame comprising a plurality of first struts and a plurality of second struts, the second struts intersecting the first struts at a plurality of junction points to form a grid network; and a plurality of panels, each of the panels attached to and suspended below the grouping frame a distance via suspension hardware comprising a first member, a second member, a third member, and a fourth member; wherein for each of the panels, each of the first and third members engages one of the first struts and each of the second and fourth members engages one of the second struts.

In another embodiment, the invention may be a ceiling system comprising: a plurality of first struts and a plurality of second struts, the second struts intersecting the first struts; a plurality of panels; for each of the plurality of panels, a plurality of hook members attached to the panel; and wherein for each of the plurality of panels, the plurality of hook members comprise a first hook member coupled to one of the first struts and a second hook member coupled to one of the second struts.

In a further embodiment, the invention may be a ceiling system comprising: at least two intersecting struts; at least two panels, for each of the two panels, at least one suspension bar attached to the panel at an in-board location of the panel, and a plurality of hook members attached to the suspension bar and extending therefrom in a direction substantially perpendicular to the suspension bar; and wherein each of the intersecting struts has at least one of the plurality of hook members coupled thereto.

In an even further embodiment, the invention may be a ceiling system comprising: a plurality of first struts and a plurality of second struts, the second struts intersecting the first struts at a plurality of junction points to form a grid network; a plurality of panels, each of the panels attached to and suspended below the plurality of first and second intersecting struts a distance via suspension hardware comprising a first member, a second member, a third member, and a fourth member; and wherein for each of the panels, each of the first and third members engages one of the first struts and each of the second and fourth members engages one of the second struts.

In another embodiment, the invention may be a ceiling system comprising: a frame comprising a plurality of struts; a plurality of modules, each module comprising a panel and a plurality of hook members coupled to and extending from a top surface of the panel; each of the hook members comprising: an upstanding section extending substantially perpendicular to the top surface of the panel; a hook portion at a top end of the upstanding section, the hook portion extending from the upstanding section in a first direction, the hook portion defining a downwardly-facing open slot; and an attachment flange at a bottom end of the upstanding section, the attachment flange comprising a front section extending from the upstanding section in the first direction, the front section vertically aligned with and located beneath the downwardly-facing open slot of the hook portion; the modules mounted to the frame, and wherein for each of the modules, the hook portions of the hook members fit over and rest upon the struts, the struts located in the downwardly-facing open slots of the hook portions.

In a further embodiment, the invention may be a ceiling system comprising: a frame comprising a plurality of modules, each of the modules comprising a panel and a plurality of hook members coupled to and extending from a top surface of the panel; each of the hook members comprising: an upstanding section; a hook portion at a top end of the upstanding section, the hook portion extending from the upstanding section in a first direction, the hook portion defining a downwardly-facing open slot; and an attachment flange at a bottom end of the upstanding, the attachment flange comprising a rear section extending from the upstanding section in a second direction that is opposite the first direction; and the modules mounted to the frame, and wherein for each of the modules, the hook portions of the hook members fit over and rest upon the struts, the struts located in the downwardly-facing open slots of the hook portions.

In another embodiment, the invention can be a ceiling system comprising: a frame comprising a first strut and a second strut that intersects the first strut; at least one panel; the at least one panel mounted to the frame by a plurality of hook members; and wherein the hook members engage only the first strut and only the second strut.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Referring now in greater detail to the figures, wherein like numerals refer to like parts throughout the drawings.

Figure 1:
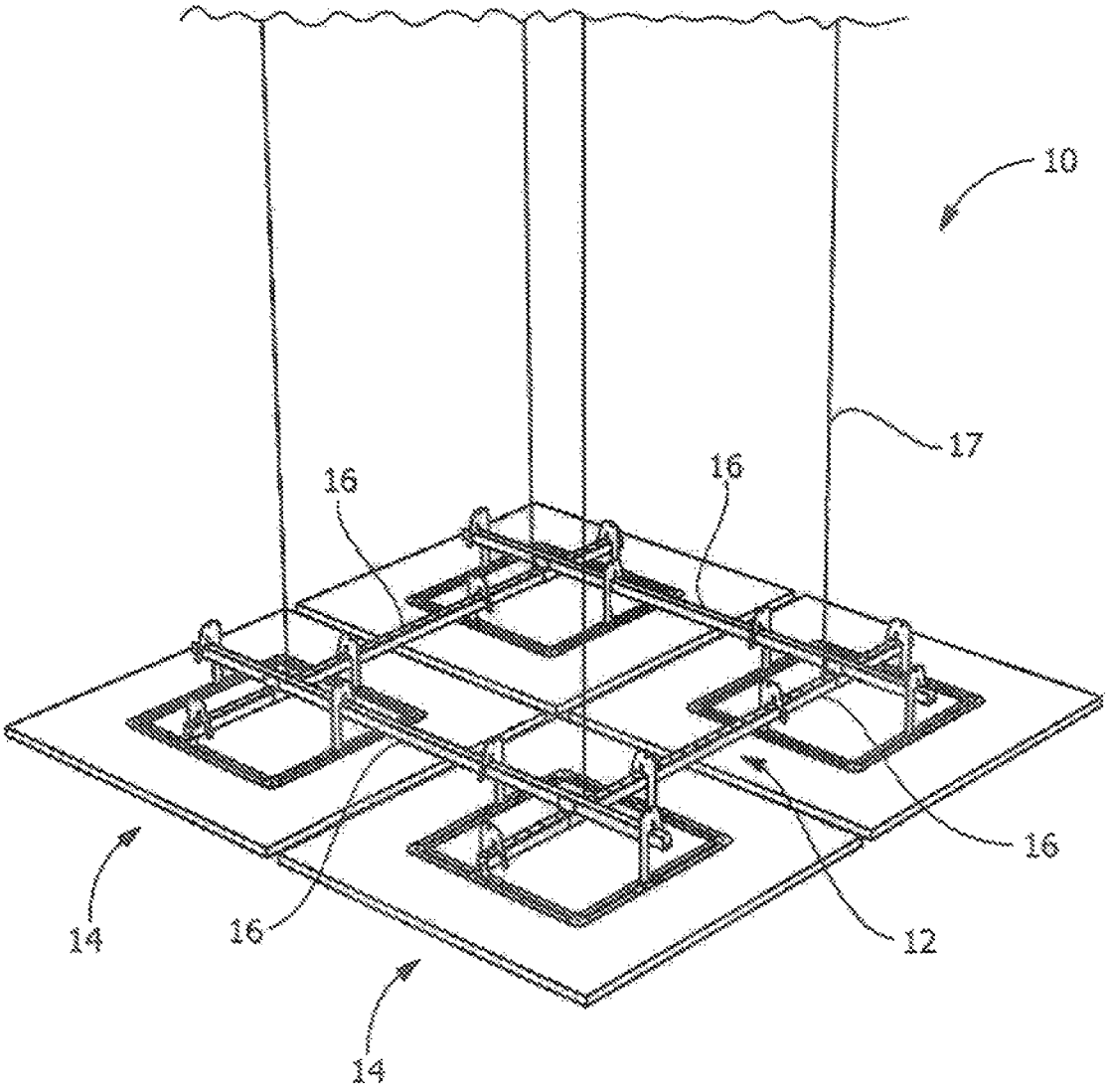
FIG. 1 is a perspective view illustrating an example embodiment of the canopy system of the invention.
Figure 2:
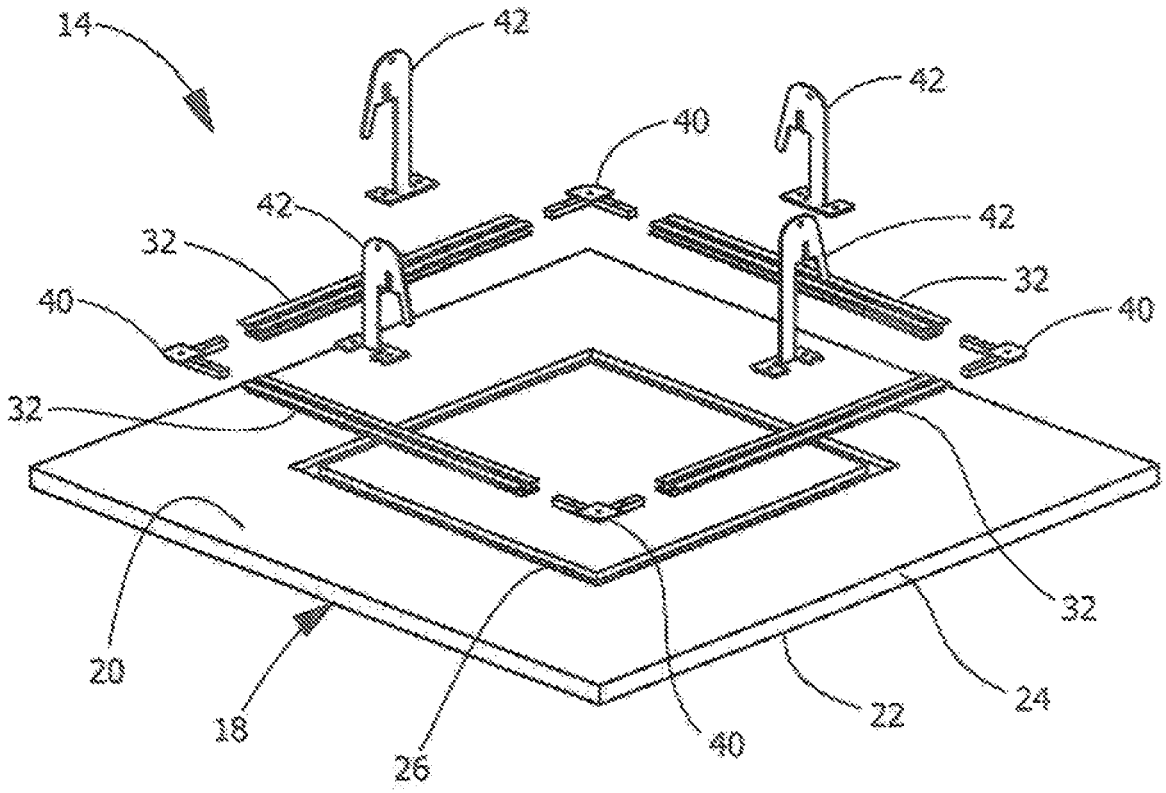
FIG. 2 is an exploded perspective view of a canopy module from FIG. 1.

FIGS. 1 and 2 illustrate the general structural arrangement of an example embodiment of the canopy system of the invention. The canopy system 10 includes a grouping frame 12 and one or more canopy modules 14. The grouping frame 12 has at least two intersecting struts 16 which are attached to one another and are supported by the overhead building structure (not shown) by a hanging device, such as the suspension cables 17 shown in FIG. 1.

As best seen on FIG. 2, the canopy module 14 has a panel 18, such as a fibrous acoustical panel or wood panel, which has a top surface 20, a bottom surface 22 and an edge 24 extending therebetween. The panel 18 includes a routed in-board channel 26 which extends from the top surface 20 in a direction toward the bottom surface 22. For purposes of this description, the term "in-board channel" refers to a channel that does not extend to an edge of the panel. This in-board feature substantially preserves the integrity of the panel and provides freedom of the edges. In other words, the edge configuration is not dictated by the support structure. Also, since the channel 26 does not extend to the edge of the panel 18, no further edge detail, such as a trim element, is required to finish the edge of the panel 18.

The canopy module 14 also includes suspension hardware, the components of which are best seen in FIGS. 2 and 3*a*-3*c*. The suspension hardware includes one or more longitudinally extending suspension bars 32 (See FIG. 3*b*). In the preferred configuration shown throughout the drawings, more than one suspension bar 32 is utilized. Here, the individual suspension bars 32 are mechanically attached to one another in the channel 26 to form an inter-locking continuous suspension bar. For example, the suspension bars can be attached via corner splices 40 (See FIG. 3*c*). When assembled to the panel, the suspension bars 32 provide rigid support for the panel in both the longitudinal and cross directional axes of the panel. Various types of suspension bars 32 can be utilized, including the extruded H-bar shown throughout the Figures and the conventional inverted-T grid members illustrated in the 2007/0033902 application publication.

Figure 3A:
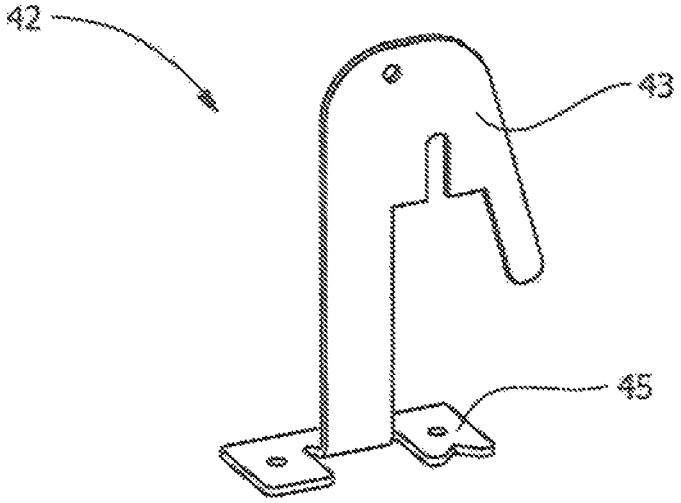
FIG. 3*a* is a perspective view of the hook shown in FIGS. 1 and 2.
Figure 3B:
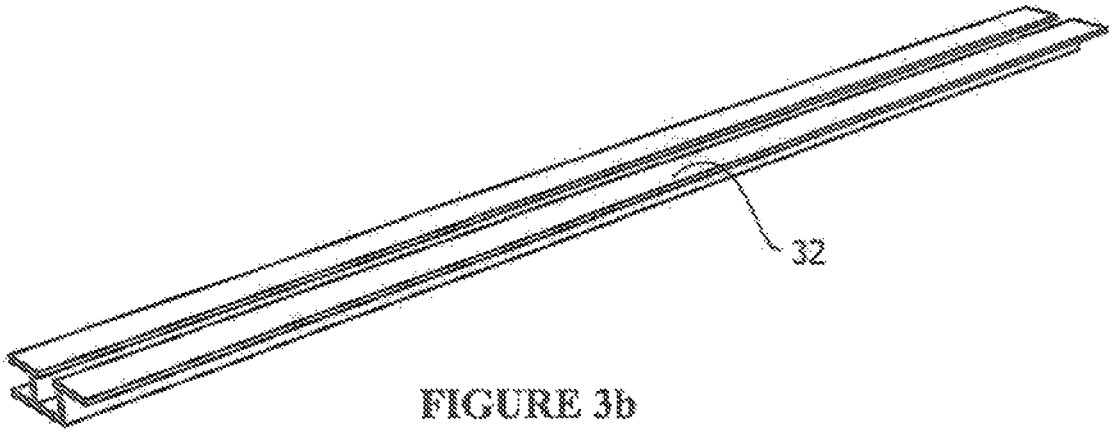
FIG. 3*b* is a perspective view of the suspension bar shown in FIGS. 1 and 2.
Figure 3C:
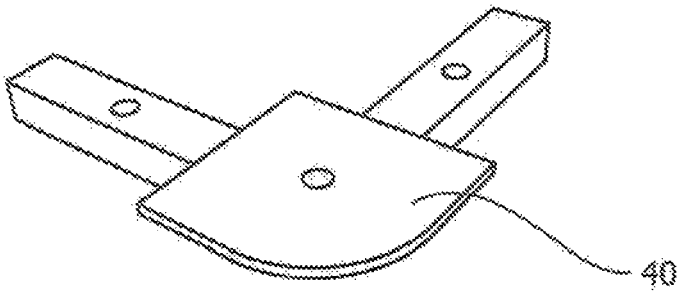
FIG. 3*c* is a perspective view of the suspension bar connector shown in FIGS. 1 and 2.

The suspension hardware also includes a plurality of hook members 42 which are fixedly attached to the longitudinally extending suspension bars 32 and extend therefrom in a direction generally perpendicular thereto. As best shown in FIG. 3*a*, the hook members 42 include a hook portion 43 at one end and an attachment flange 45 at the opposite end. The example hook members shown in the drawings are of general J shape and are preferably attached to the suspension bars 32 via the attachment flange 45 at an interior position of a respective suspension bar 32. Preferably, for a more fixed attachment, the hook portion 43 includes detailing which conforms to the shape of the intersecting struts 16 so that the hook member 42 will fit over and around, and ultimately rest upon, the intersecting struts 16. For example, the hook members are shown to be attached at the center of the suspension bar so that they will be attachable to the intersecting struts of the grouping frame as described in greater detail below.

The panel module 14 is installed on the grouping frame 12 by resting the hook members 42 over the struts 16 of the grouping frame 12. For ease of installation, the hook portion of the hook members all face the same direction, i.e. they each face in either the clockwise or counterclockwise direction. For illustration purposes, each hook portion of the hook members shown throughout the drawings face the counterclockwise direction.

Figure 4A:
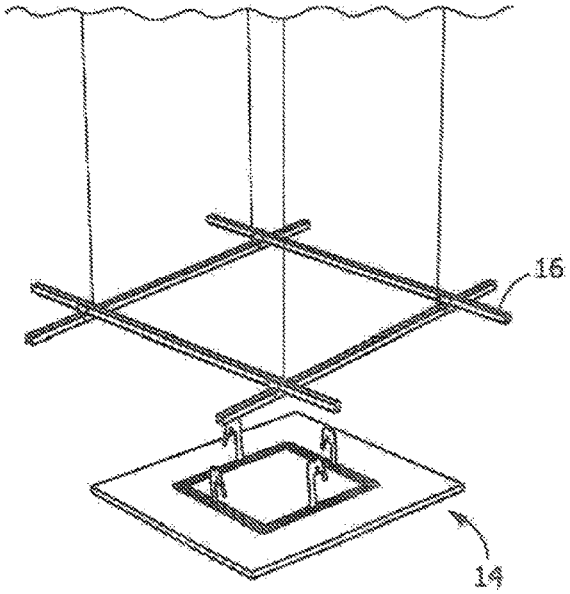
FIG. 4*a* is a perspective view showing the first step of the progressive steps for installing a canopy module on the grouping frame.
Figure 4B:
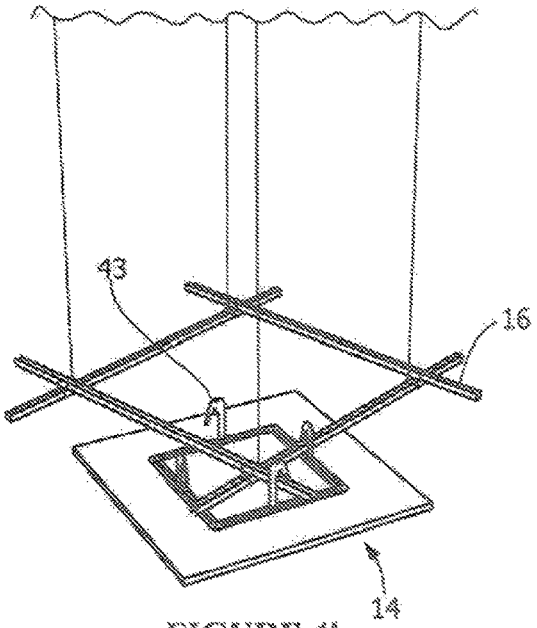
FIG. 4*b* is a perspective view showing the second step of the progressive steps for installing a canopy module on the grouping frame.
Figure 4C:
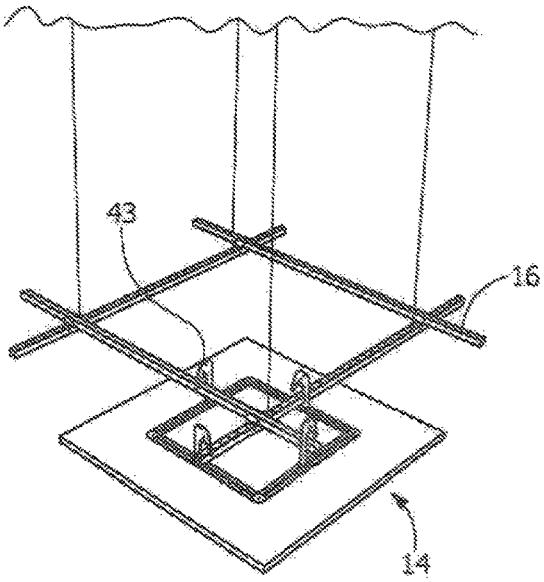
FIG. 4*c* is a perspective view showing the third step of the progressive steps for installing a canopy module on the grouping frame.
Figure 4D:
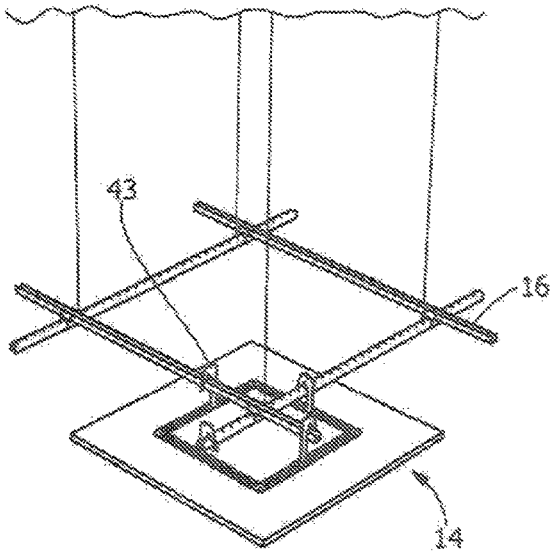
FIG. 4*d* is a perspective view showing the fourth step of the progressive steps for installing a canopy module on the grouping frame.

The progressive steps of attaching the canopy modules 14 onto the grouping frame are now described in greater detail with respect to FIGS. 4*a*-4*d*. As illustrated, the canopy modules 14 are downward accessible, i.e. the modules 14 are inserted up onto the grouping frame from a position below the grouping frame (as shown in FIG. 4*a*). As shown in FIG. 4*b*, the module is lifted upwardly until the hook portions 43 of all the hook members 42 are positioned above the intersecting struts 16. As shown in FIG. 4*c*, the module 14 is then rotated in a counterclockwise direction, i.e. the same direction in which the hook members are facing, until the hook portion of the hook members are positioned over the struts of the grouping frame. The struts 16 essentially act as a stop for movement of the canopy module in the counterclockwise direction. As shown in FIG. 4*d*, the module 14 is then allowed to drop down until the hook portion of the hook members engage, and rest upon, the intersecting struts 16.

The grouping frame 12, therefore, works in combination with the hook members 42 of the canopy module 14 to permit the modules to be easily locked onto the grouping frame in both the longitudinal and cross axes. Additionally, due to the installation procedure afforded by the components of the canopy modules, the modules can be installed on the grouping frame in close proximity to one another. Also, by attaching the modules to a grouping frame, the modules are indirectly attached to one another and are easily aligned and registered relative one another.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of installing a ceiling system comprising:

a) raising a panel having an upper surface opposite a lower surface and a plurality of hook members extending from the upper surface to a height where hook portions of the hook members are above struts of a grouping frame;

b) creating relative movement between the panel and the grouping frame until the hook portions are aligned with and above the struts; and c) lowering the panel until the hook portions engage the struts, thereby supporting the panel from the grouping frame; and wherein each of the plurality of hook members comprise an open front side, an opposing rear side, and lateral sides perpendicular to the open front side and the rear side.

2. The method of claim 1 wherein the hook portions of the plurality of hook members define a downwardly-facing open slot and the struts located in the downwardly-facing open slots of the hook portions.

3. The method of claim 1 wherein the hook members are located inboard of an edge of the panel.

4. The method of claim 1 wherein in step a), the hook portions of the hook members are above an uppermost surface of the struts of the grouping frame.

5. The method of claim 1 wherein in step b) the struts are positioned beneath the hook portions via the open front sides.

6. The method of claim 1 wherein a first pair of the plurality of hook members are aligned such that the lateral sides of the first pair of hook members are parallel.

7. The method of claim 1 wherein a first distance between the lateral sides is less than a second distance between the open front side and the rear side.

8. The method of claim 1 wherein a first pair of the plurality of hook members engage a first strut and a second pair of the plurality of hook members engage a second strut.

9. The method of claim 1 further comprising:

d) repeating steps a) through c) to install a second panel, both the panel and the second panel engaging a first strut.

10. A method of installing a ceiling system comprising:

a) raising a panel having an upper surface opposite a lower surface and a plurality of hook members extending from the upper surface to a height where hook portions of the hook members are above an uppermost surface of respective ones of a plurality of struts of a grouping frame;

b) creating relative movement between the panel and the grouping frame until the hook portions are aligned with and above the struts; and c) lowering the panel until the hook portions engage the struts, thereby supporting the panel from the grouping frame;

wherein each hook portion faces the same direction, and wherein the same direction is either a clockwise or counterclockwise direction.

11. A method of installing a ceiling system comprising:

a) raising a panel having an upper surface opposite a lower surface and a plurality of hook members extending from the upper surface to a height where hook portions of the hook members are above struts of a grouping frame, each of the plurality of hook members comprising an open front side, an opposing rear side, and lateral sides perpendicular to the open front side and the rear side, a first pair of the plurality of hook members are aligned such that the lateral sides of the first pair of hook members are parallel;

b) creating relative movement between the panel and the grouping frame until the hook portions are aligned with and above the struts; and c) lowering the panel until the hook portions engage the struts, thereby supporting the panel from the grouping frame.

* * * * *